US009220350B2

(12) United States Patent
Best et al.

(10) Patent No.: US 9,220,350 B2
(45) Date of Patent: Dec. 29, 2015

(54) BIASING FITNESS CHAIR

(71) Applicants: Kristine Sanslow Best, Concord, NC (US); David Allen Crawford, Huntersville, NC (US)

(72) Inventors: Kristine Sanslow Best, Concord, NC (US); David Allen Crawford, Huntersville, NC (US)

( * ) Notice: Subject to any disclaimer, the term of this patent is extended or adjusted under 35 U.S.C. 154(b) by 87 days.

(21) Appl. No.: 14/032,253

(22) Filed: Sep. 20, 2013

(65) Prior Publication Data

US 2014/0094352 A1 Apr. 3, 2014

Related U.S. Application Data

(60) Provisional application No. 61/703,346, filed on Sep. 20, 2012.

(51) Int. Cl.

| | |
|---|---|
| ***A63B 21/02*** | (2006.01) |
| ***A63B 21/04*** | (2006.01) |
| ***A47C 9/00*** | (2006.01) |
| ***A63B 23/035*** | (2006.01) |
| ***A63B 21/055*** | (2006.01) |
| ***A63B 21/00*** | (2006.01) |
| ***A63B 23/04*** | (2006.01) |
| ***A63B 23/12*** | (2006.01) |
| *A63B 21/16* | (2006.01) |

(52) U.S. Cl.

CPC ..... *A47C 9/002* (2013.01); *A63B 21/0442* (2013.01); *A63B 21/0552* (2013.01); *A63B 21/1461* (2013.01); *A63B 21/1469* (2013.01); *A63B 21/151* (2013.01); *A63B 23/0355* (2013.01); *A63B 23/03508* (2013.01); *A63B 23/03541* (2013.01); *A63B 23/03558* (2013.01); *A63B 23/04* (2013.01); *A63B 23/12* (2013.01); *A63B 21/0557* (2013.01); *A63B 2021/1609* (2013.01); *A63B 2208/0233* (2013.01); *A63B 2210/02* (2013.01); *A63B 2210/50* (2013.01)

(58) Field of Classification Search

CPC ..... A63B 21/1461; A63B 21/151; A63B 21/0552; A63B 23/03558; A63B 23/0355; A63B 23/1461; A63B 23/1609; A63B 23/16; A63B 21/00047; A63B 21/00083; A63B 21/00087; A63B 21/0009; A63B 21/00123; A63B 21/00127; A63B 21/04; A63B 21/0407; A63B 21/0421; A63B 21/0428; A63B 21/0435; A63B 21/055; A63B 21/0555; A63B 21/0557; A63B 21/148; A47C 9/002; A47C 9/005

USPC ..... 297/301.4, 411.32, 411.38, 411.39

See application file for complete search history.

(56) References Cited

U.S. PATENT DOCUMENTS

| | | | | | |
|---|---|---|---|---|---|
| 136,956 | A * | 3/1873 | Baughman | ..... | 297/301.4 |
| 2,147,958 | A * | 2/1939 | Angers | ..... | 297/301.4 |
| 4,733,862 | A * | 3/1988 | Miller | ..... | 482/126 |
| 5,277,684 | A * | 1/1994 | Harris | ..... | 482/130 |
| 5,578,486 | A * | 11/1996 | Zhang | ..... | 435/243 |
| 5,624,361 | A * | 4/1997 | Lai | ..... | 482/130 |
| 7,159,943 | B2 * | 1/2007 | Costaglia | ..... | 297/323 |
| 2002/0039953 | A1 * | 4/2002 | Spiel | ..... | 482/92 |
| 2003/0220176 | A1 * | 11/2003 | O'Connor | ..... | 482/142 |
| 2008/0203776 | A1 * | 8/2008 | Mongelluzzo et al. | ..... | 297/118 |

* cited by examiner

*Primary Examiner* — Oren Ginsberg
*Assistant Examiner* — Nyca T Nguyen
(74) *Attorney, Agent, or Firm* — Clements Bernard PLLC; Seth L. Hudson

(57) ABSTRACT

The present invention provides methods and systems for a fitness device that includes a frame having a horizontal portion and a vertical portion that are hingedly connected, a back engaged to the vertical portion of the frame, a seat engaged to the horizontal portion of the frame, and two pairs of legs extending away from the horizontal portion of the frame for positioning the fitness device on a surface.

14 Claims, 7 Drawing Sheets

BIASING FITNESS CHAIR

CROSS REFERENCE TO RELATED PATENT APPLICATION

The current application claims the benefit of the earlier priority filing date of provisional application Ser. No. 61/703,346 that was filed on Sep. 20, 2012.

FIELD OF THE INVENTION

The present invention relates generally to a fitness device and more particularly relates to a fitness device that sits upon the ground and allows a user to engage in multiple fitness activities that work various parts of the body while using only one small, mobile, and efficient device.

BACKGROUND OF THE INVENTION

Many individuals attempt to exercise at home out of convenient or necessity. They may hire a highly skilled personal trainer with the knowledge and expertise to craft a workout routine specifically tailored to the individual's needs. These individuals have the option of purchasing large bulky equipment that claims to work every aspect of the user's body and provides various and diverse exercise routines. The problem with this equipment is that it is bulky, expensive, and doesn't work all elements of the body.

Alternatively, the personal trainer may have to haul and unload numerous weights, bands, balls, and the like to residence of their client for a workout session. There is a need for a device that is compact, easy to use, and works the essential aspects of a user's body. The present invention is compact, mobile, relatively inexpensive, and works all aspects of the body.

BRIEF SUMMARY OF THE INVENTION

According to an embodiment of the present invention, a fitness device that includes a frame having a horizontal portion and a vertical portion are hingedly connected to one another, a back is engaged to the vertical portion of the frame, a seat is engaged to the horizontal portion of the frame, and two pairs of legs extend away from the horizontal portion of the frame for positioning the fitness device on a surface.

According to yet another embodiment of the present invention, the fitness device includes a horizontal portion and a vertical portion of the frame that are engaged to one another by a biasing element creating a downward force upon the vertical portion of the frame.

According to yet another embodiment of the present invention, the fitness device includes a first rod engaged to the vertical portion of the frame and a second rod engaged to the horizontal portion of the frame and having at least one biasing element disposed between the first rod and second rod.

According to yet another embodiment of the present invention, the fitness device includes an arm rotationally engaged to a first rod disposed on the frame.

According to yet another embodiment of the present invention, the fitness device includes a resistance device engaged to one end of the arm.

According to yet another embodiment of the present invention, the fitness device includes a rod disposed between at least two of the legs of the fitness device and has at least one spring hook disposed thereon for receiving a resistance band.

According to yet another embodiment of the present invention, the fitness device includes a brace that locks the vertical portion of the frame and the horizontal portion of the frame in a stationary position.

According to yet another embodiment of the present invention, the fitness device includes a seat and back that may be composed of a vinyl covering and a frame that may be composed of aluminum. However, the seat, back, and frame may be composed of any material as desired by the user.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 3:
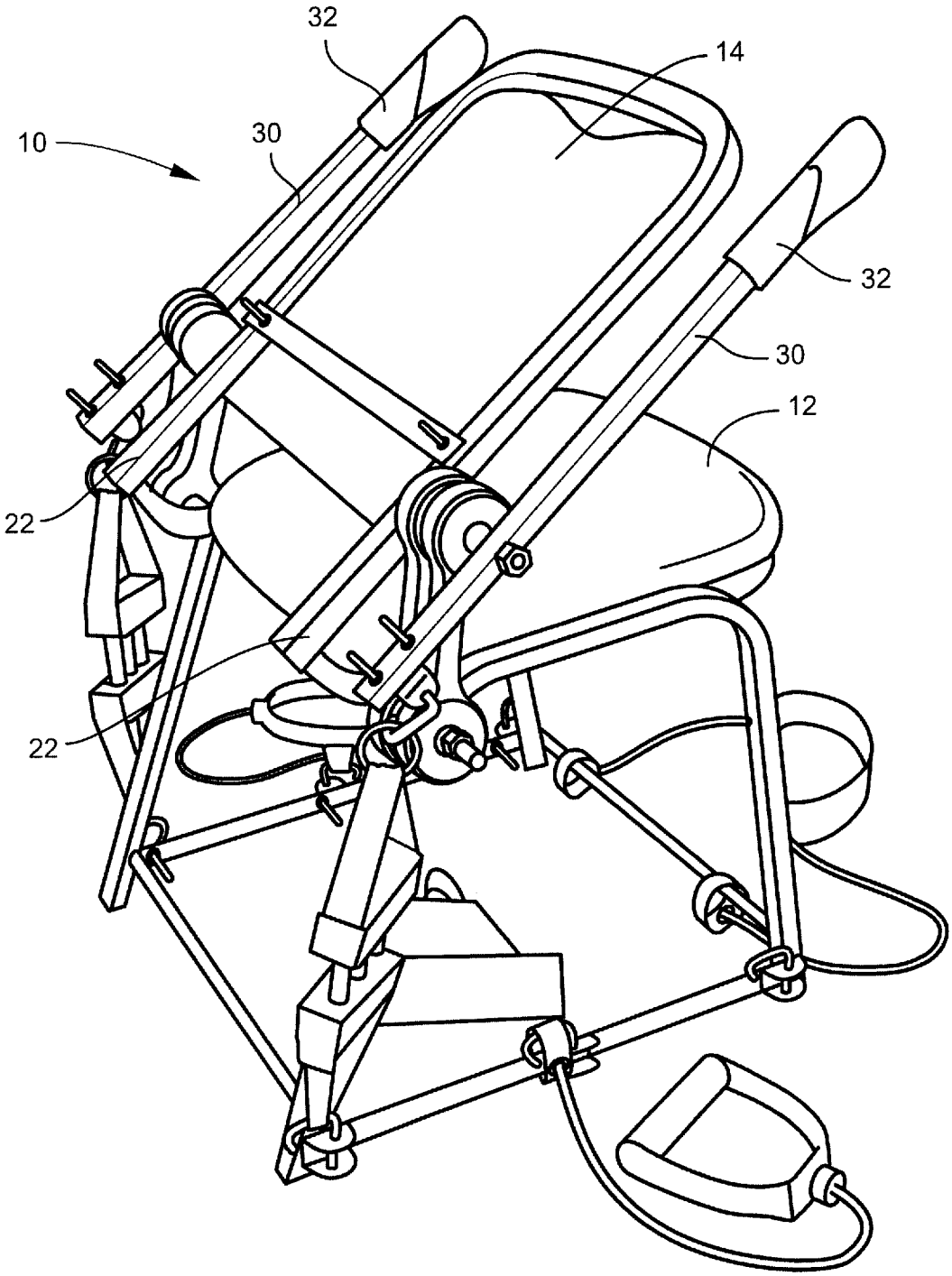
FIG. 3 is a perspective back view of the fitness device.

Referring now specifically to the drawings, a fitness device is illustrated in FIGS. 1-4 and is shown generally at reference numeral 10. The device 10 has a seat 12 with a top portion and a bottom portion and a back 14. The seat 12 and back 14 both sit on a frame 16. The frame 16 has a vertical portion 18 and a horizontal portion 20 and a first side and a second side. Preferably, the first side is the left side of the frame 16 and the second side is the right side of the frame 16 from the perspective of an individual looking at the device 10 from the front. The seat 12 is engaged to the horizontal portion 20 of the frame 16, and the back 14 is engaged to the vertical portion 18 of the frame 16. The frame 16 includes a hinge 22 that allows the back 14 to pivot towards the seat 12 and horizontal portion 20. Four spaced-apart legs 16 extend downwardly from the horizontal portion 20 of the frame 16. As illustrated in FIG. 3, the frame 16 may include a cantilevered portion that extends from the first side and the second side of the frame 16 and generally horizontally away from the frame 16. The vertical portion 18 of the frame 16 is hingedly connected to the cantilevered portion of the frame 16 by a hinge.

Figure 1:
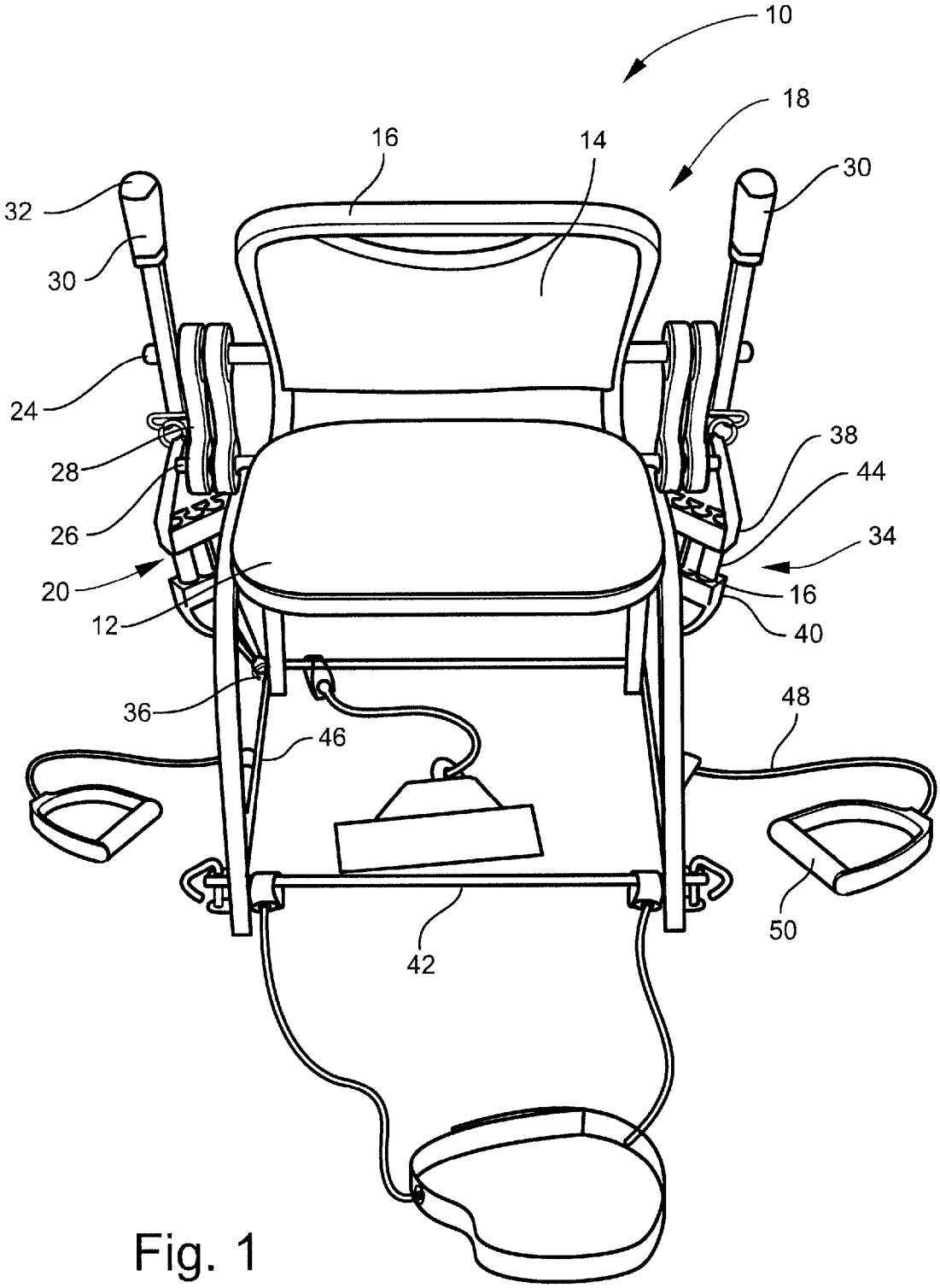
FIG. 1 is a perspective view of the fitness device.
Figure 2:
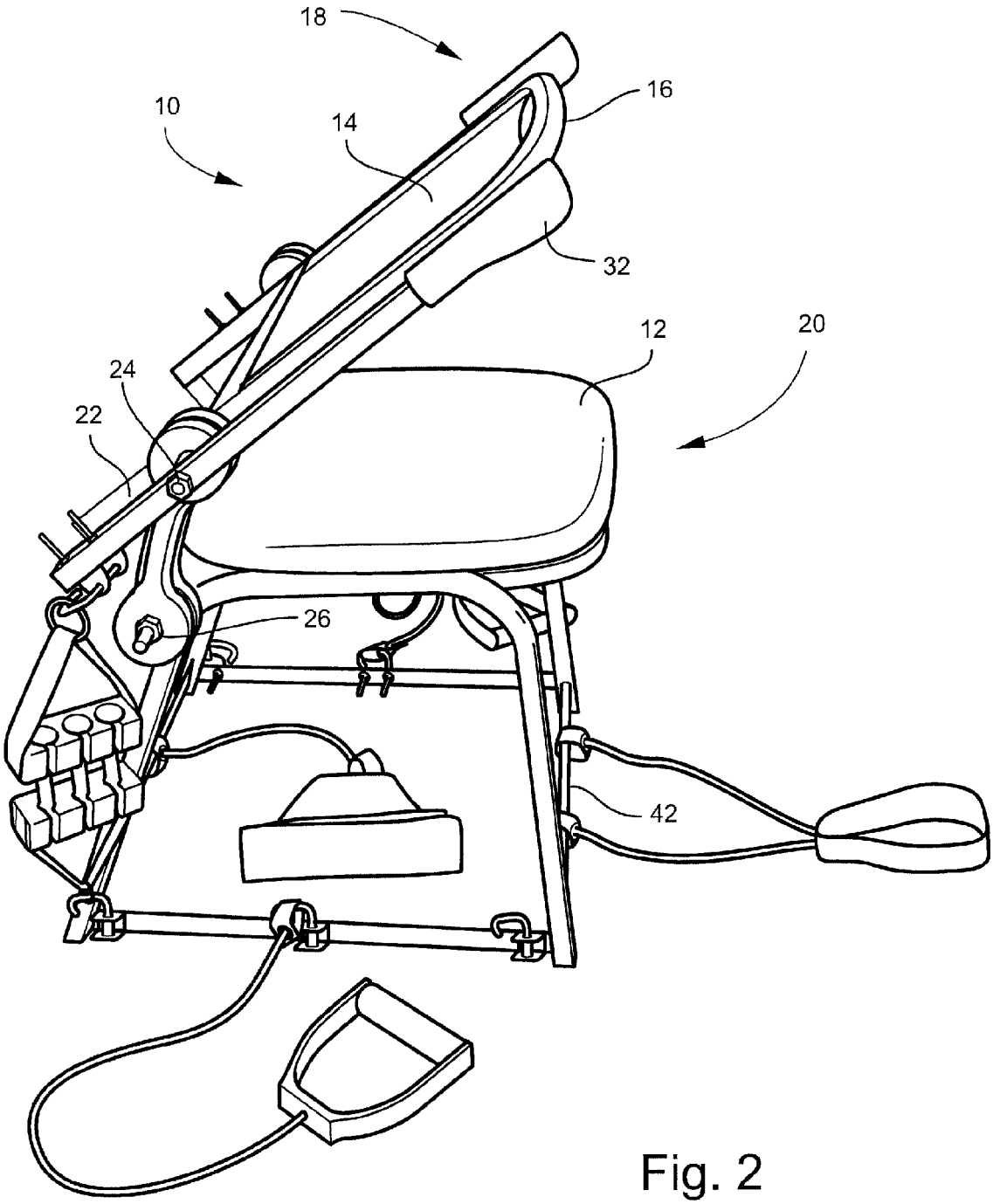
FIG. 2 is a side view of the fitness device.
Figure 5:
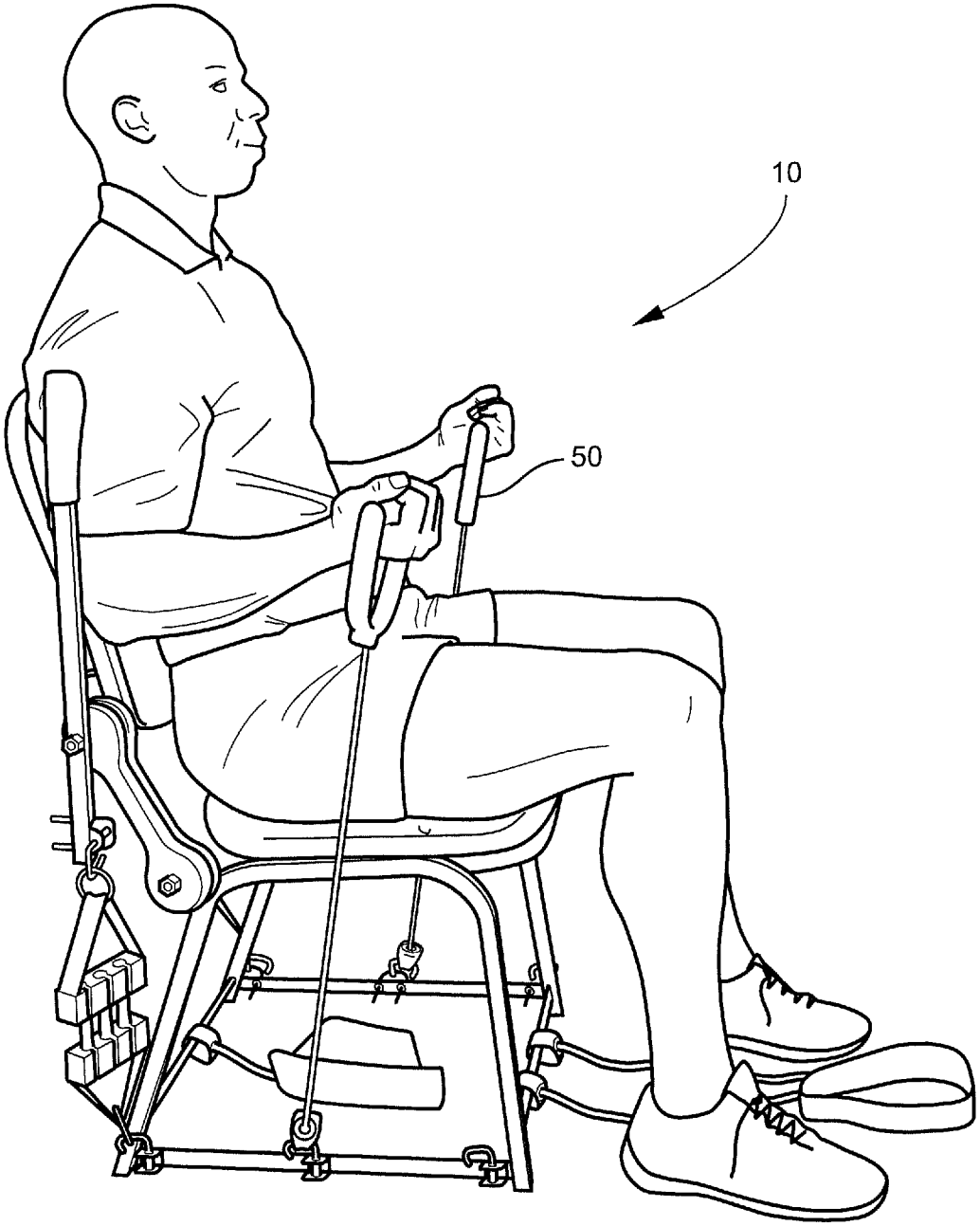
FIG. 5 is a side view of the fitness device in use.

A first retention element 24 extends perpendicularly from the first side of the vertical portion 18 of the frame 16 and a first retention element extends perpendicularly from the second side of the vertical portion 18 of the frame 16. A second retention element 26 extends perpendicularly from the first side of the horizontal portion 20 of the frame 16 and a second retention element 26 extends perpendicularly from the second side of the horizontal portion 20 of the frame 16. The first retention element 24 and second retention element 26 may be a rod or threaded bolt that receives a correspondingly threaded nut. At least one biasing element 28 is disposed between the first retention element 24 and second retention element 26 on the first side and second side of the frame 16. The biasing element 28 contains a first portion that is generally circular and contains a first bore for receiving the first retention element 24 and a second portion that is generally circular and contains a second bore for receiving the second retention element 26 and an elongate member that connects the first portion and the second portion. As illustrated in FIG. 5, the first retention element 24 and second retention element 26 is a threaded rod or bolt and a correspondingly threaded nut is inserted on the elements (24, 26) on the outside of the biasing elements 28 to retain the biasing elements 28 on the retention elements (24, 26). The elongate member is elastic and has a predetermined resting state. Preferably, the resting state is shown in FIG. 1 when the vertical portion 18 of the frame 16 is rotated towards the horizontal portion 20 of the frame. When the vertical portion 18 of the frame 16 is rotated backwards, as when an individual is seated on the device 10 as illustrated in FIG. 5, the biasing element 28 is elongated or stretched, creating a resistance.

As illustrated in FIG. 3, the device 10 may include two biasing elements 28 on the first side and the second side of the frame 16. The biasing elements 28 exert a tension on the first retention element 24 and second retention element 26, causing the back 14 or vertical portion 18 to pivot or rotate towards the seat 12 or horizontal portion 20 along the axis of the hinge 22. In another alternative embodiment, the biasing elements 28 may be springs, but the biasing elements 24 may be any other device that may provide a tension upon the first retention element 24 and the second retention element 26 when the back 14 or vertical portion 18 is rotated or pivoted away from the horizontal portion 20. Other embodiments of the biasing elements 24 may be a resistance band composed of rubber, leaf spring, or the like. As shown, each of the biasing elements 28 exert 10 lbs of force, and the user may add biasing elements 28 to create the maximum amount resistance. On the other hand, the user may only attach one or more than one biasing element 28 to create a desired amount of resistance. It should be noted by one of ordinary skill in the art that any biasing element 298 that exerts any amount of resistance that may be desired by a user can be incorporated into the device 10.

A brace having a first end and a second end is disposed between the horizontal portion 20 of the frame 16 and the vertical portion 18 of the frame 16. In other words, the first end of the brace is engaged to the horizontal portion 20 of the frame 16, and the second end of the brace is engaged to the vertical portion 18 of the frame 16. The brace prevents the back 14 from pivoting forward towards the seat 12, thus keeping the back 14 upright.

Figure 4:
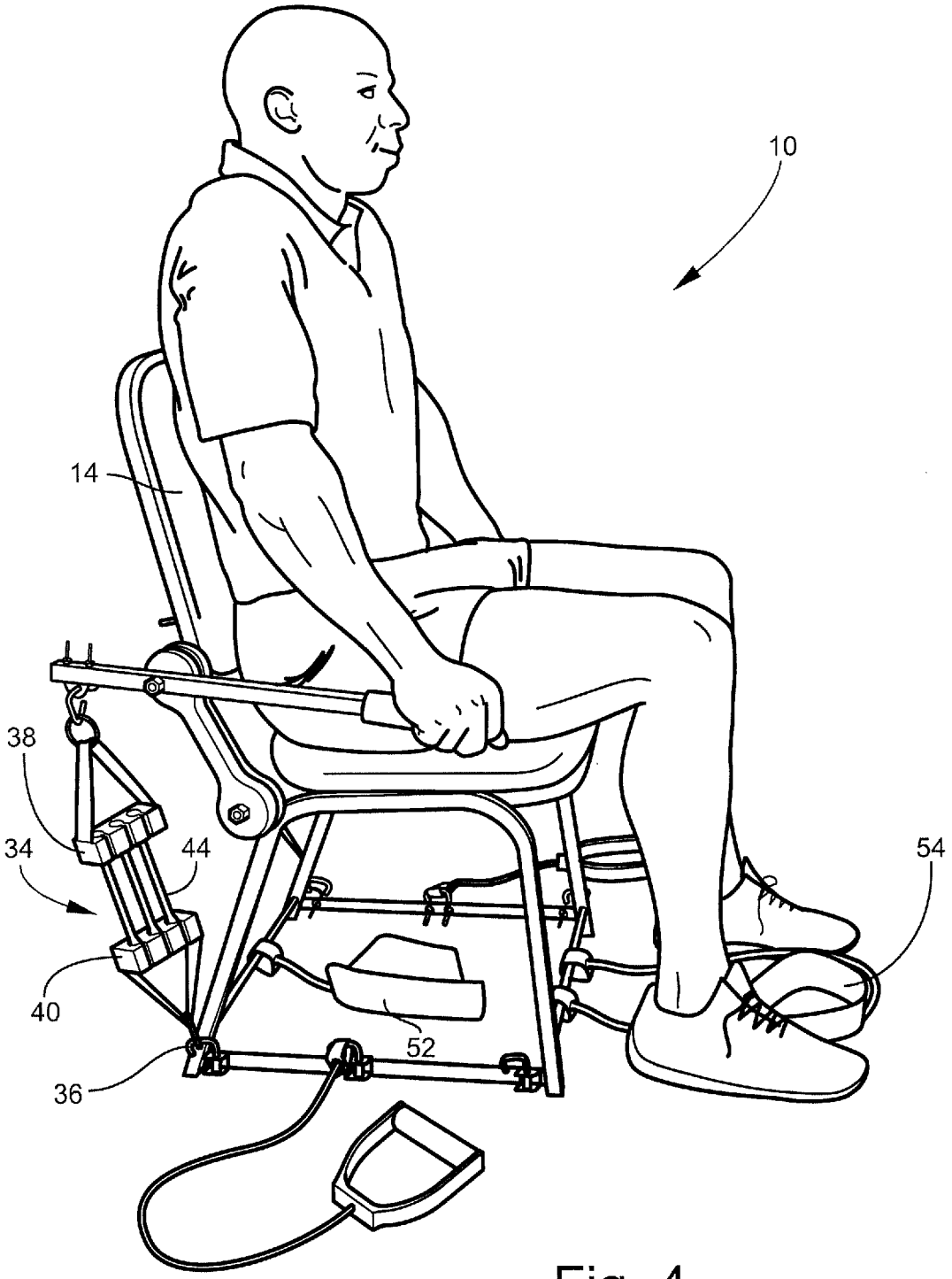
FIG. 4 is a side view of the fitness device in use.
Figure 6:
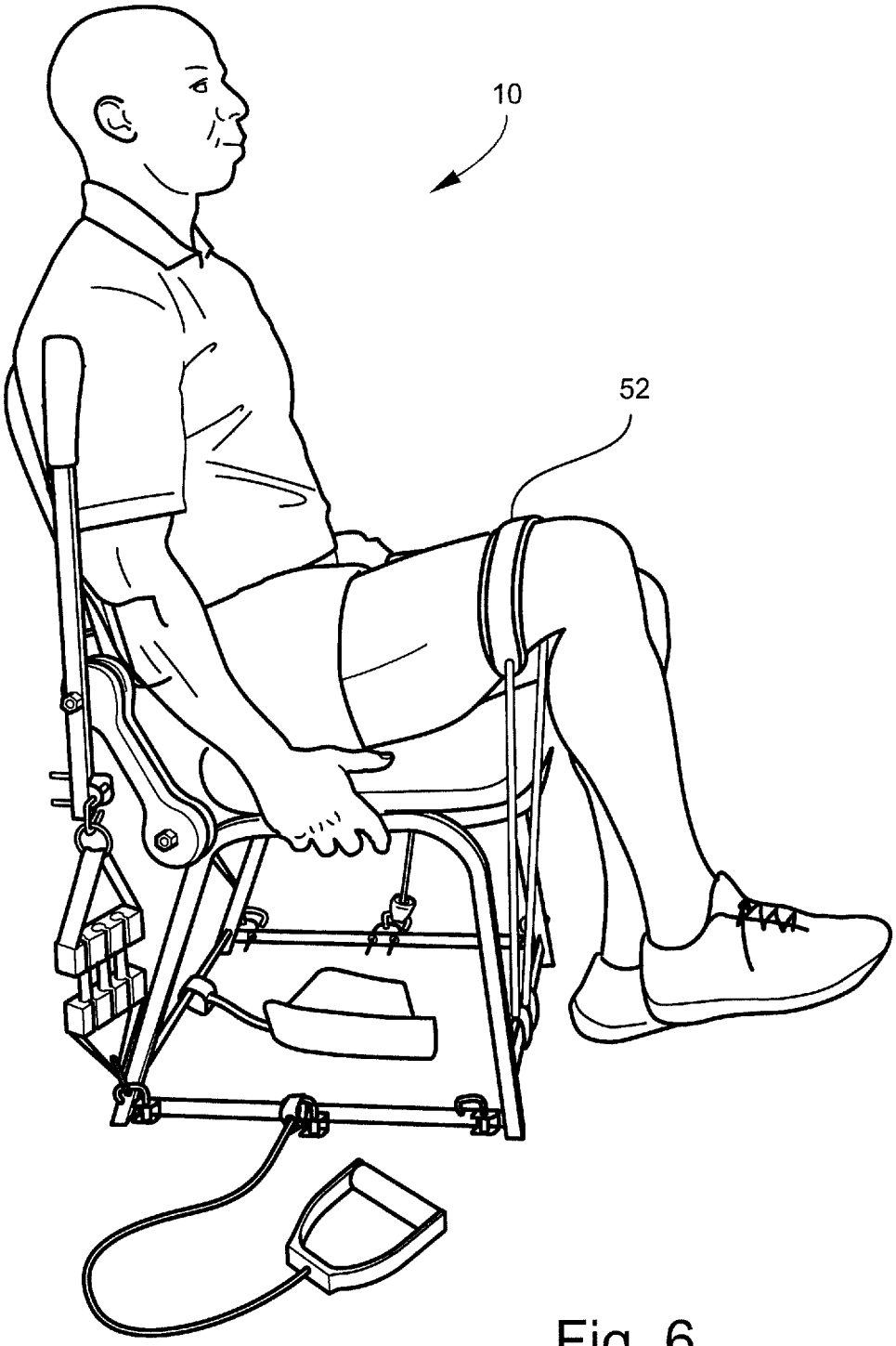
FIG. 6 is a side view of the fitness device in use.

As illustrated in FIG. 4, a pair of arms 30 are pivotally disposed on the first retention element 24. Each arm 30 has a first end and a second end. The first end of each arm 30 contains a handle 32 for allowing a user to grip the arm 30. The second end is engaged to a resistance device 34. The second end of the arm 30 contains a hook 36 that is engaged to an engagement means, such as a hook, ring, or the like, with a meshed fabric extending there through. The meshed fabric is engaged to a first end 38 of the resistance device 34. The second end 40 of the resistance device 34 is composed of mesh and contains an engagement means, such as a hook, ring, or the like. The engagement means of the second end 40 is engaged to a hook or other engagement means attached to either a leg of the device 10 or a stabilizer bar 42. At least one resistance band 44 is disposed between the first end 38 and second end 40. The resistance band 44 has a first end and a second end, wherein the first end is engaged to the first end 38 of the resistance device 34 and the second end is engaged to the second end 40 of the resistance device 34. As shown in FIG. 6, the resistance device 34 includes three resistance bands 44. Each resistance band 44 contains a cap that slides within a slot on the top shelf and bottom shelf for selectively engaging the resistance band to the top shelf and bottom shelf. The bottom shelf is engaged to mesh fabric that is engaged to the bottom of the back legs of the device 10.

As shown in FIG. 4, the user grips the handle 32 of the arms 30 and pushes in the downward direction. The first retention element 24 acts as a fulcrum and while the first end of the arm 30 moves downward, the second end of the arm 30 moves upward. The resistance device 34 provides resistance against the upward movement of the second end of the arm 30. The resistance device 34 also pulls the second end in the downwards direction, once the user has caused the second end to move in the upward direction.

Figure 7:
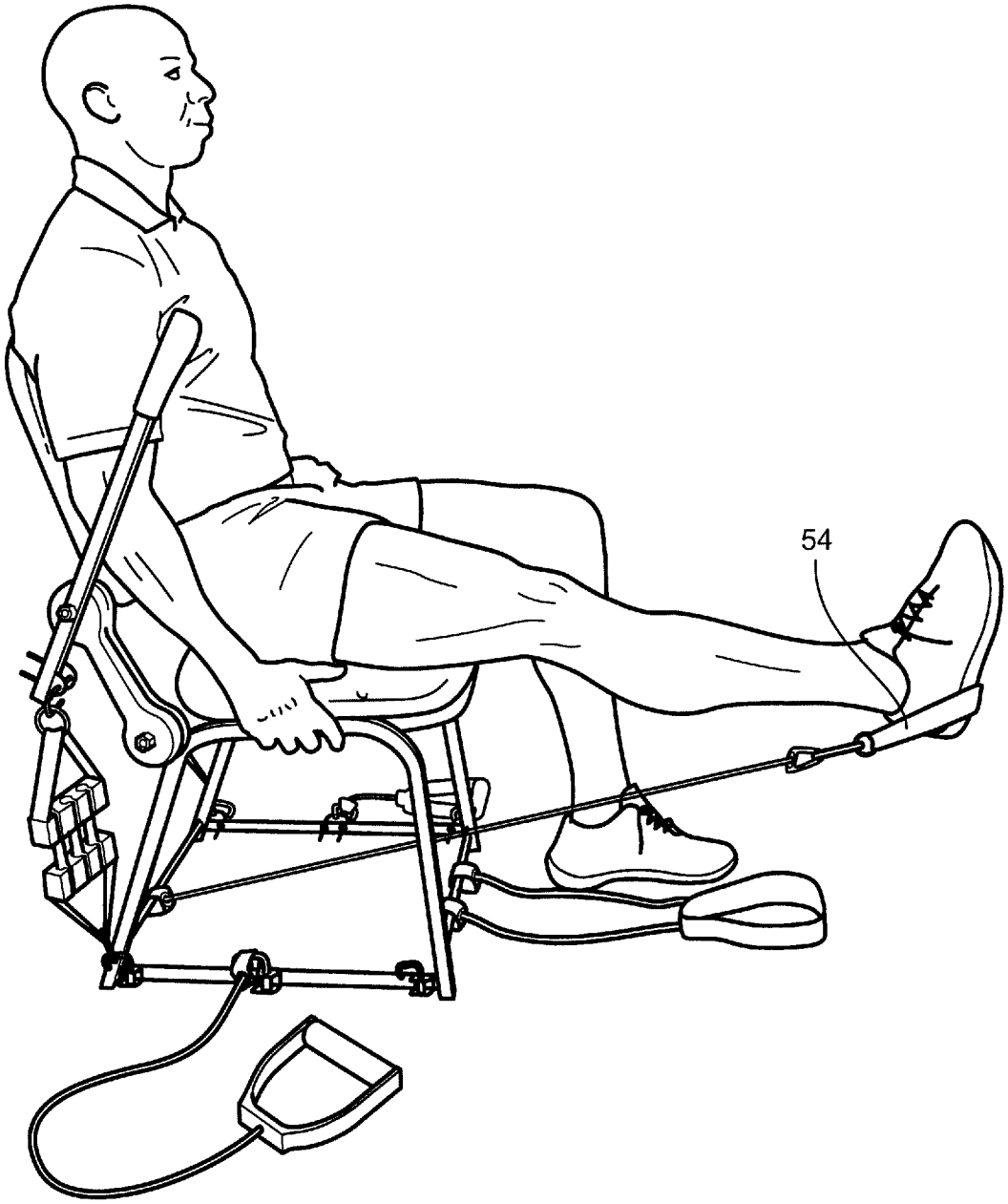
FIG. 7 is a side view of the fitness device in use.

A stabilizer bar 42 is disposed between the front leg and back leg on first side and the second side of the device 10. Additionally, a stabilizer bar 42 is disposed between each of the four legs. A number of spaced-apart retention means, such as hooks 46, are disposed on the stabilizer bar 42. As illustrated in FIG. 7, the stabilizer bar 42 preferably contains 3 hooks 46, wherein a first hook 46 is disposed in close proximity to one leg and a second hook 46 is disposed in close proximity to the opposite leg, and a middle hook 46 is disposed between the first and second hook 46 are disposed on each stabilizer bar 42. The hooks 46 are designed to receive resistance bands 48 which have a first end and a second end. The first end of the resistance band 48 engages to the hook 46 by way of a hook, strap, or the like. The second end of the resistance band 46 is engaged to an exercise component, allowing the user to utilize the resistance band 46 during exercise. As illustrated in FIG. 5, a handle 50 may be engaged to the second end of the resistance band 40. Alternatively, a leg band 52, as shown in FIG. 6, may be engaged to the second end of the resistance band 48. In another alternative, a foot band 54 may be engaged to the resistance band 48, as shown in FIG. 7. One of ordinary skill in the art will recognize a number of different and unique instruments may be engaged to the second end of the resistance band 48 for allowing a user to utilize the device 10 and conduct exercise routines.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A fitness device comprising:

a frame having a horizontal portion and a vertical portion that are hingedly connected, with the vertical portion having a first side and a second side;

a back engaged to the vertical portion of the frame;

a seat engaged to the horizontal portion of the frame;

a biasing element having a first portion and a second portion, wherein the first portion is engaged to the horizontal portion and the second portion is engaged to the vertical portion;

at least two legs extending away from the horizontal portion of the frame for positioning the fitness device on a surface, said at least two legs comprises a first leg and a second leg;

a first arm rotationally engaged to the first side of the vertical portion having a first end and a second end, the second end of the first arm is engaged to a resistance device having a first end and a second end, the first end of the resistance device is engaged to the second end of the first arm and the second end of the resistance device is engaged to an engagement device positioned adjacent a first leg; and a second arm rotationally engaged to the second side of the vertical portion having a first end and a second end, the second end of the second arm is engaged to a resistance device having a first end and a second end, the first end of the resistance device of the second arm is engaged to the second end of the second arm and the second end of the resistance device of the second arm is engaged to an engagement device positioned adjacent a second leg.

2. The fitness device of claim 1, wherein the biasing element is a retention band.

3. The fitness device of claim 1, further comprising a first retention rod engaged to the vertical portion of the frame and a second retention rod engaged to the horizontal portion of the frame and having the biasing element disposed between the first rod and second rod.

4. A fitness device comprising:

a frame having a horizontal portion with a first side and a second side and a vertical portion with a first side and a second side, the horizontal portion and vertical portion are hingedly connected;

a back engaged to the vertical portion of the frame;

a seat engaged to the horizontal portion of the frame;

a retention element engaged to the first side of the vertical portion of the frame, a retention element engaged to the second side of the vertical portion of the frame, a retention element engaged to the first side of the horizontal portion of the frame, and a retention element engaged to the second side of the horizontal portion of the frame;

a first arm rotationally engaged to the first side of the vertical portion having a first end and a second end, the second end of the first arm is engaged to a resistance device having a first end and a second end, the first end of the resistance device is engaged to the second end of the first arm and the second end of the resistance device is engaged to an engagement device positioned adjacent a first leg; and a second arm rotationally engaged to the second side of the vertical portion having a first end and a second end, the second end of the second arm is engaged to a resistance device having a first end and a second end, the first end of the resistance device of the second arm is engaged to the second end of the second arm and the second end of the resistance device of the second arm is engaged to an engagement device positioned adjacent a second leg;

a biasing element having a first portion and a second portion, wherein the first portion is engaged to the retention element on the first side of the vertical portion of the frame and the second portion is engaged to the retention element on the first side of the horizontal portion of the frame; and a second biasing element having a first portion and a second portion, wherein the first portion of the second biasing element is engaged to the retention element on the second side of the vertical portion of the frame and the second portion of the second biasing element is engaged to the retention element on the second side of the horizontal portion of the frame.

5. The fitness device of claim 4, wherein the first portion of the biasing elements are generally circular and contains a first bore for receiving the retention elements of the vertical portion and the second portion of the biasing elements are generally circular and contains a second bore for receiving the retention elements of the horizontal portion and an elongate member that connects the first portion and the second portion.

6. The fitness device of claim 4, wherein the biasing elements is are a spring.

7. The fitness device of claim 4, further comprising a first pair of legs and a second pair of legs, wherein said first pair of legs comprises said first leg and said second leg, the first pair of legs and the second pair of legs are opposed pairs of legs engaged to the horizontal portion of the frame and containing a stabilizer bar that spans between the first pair of legs and the second pair of legs.

8. The fitness device of claim 7, further comprising a first retention band engaged to the stabilizer bar engaged to the first pair of legs and a second retention band engaged to the stabilizer bar engaged to the second pair of legs, the first retention band includes a handle and a second retention band includes a handle.

9. The fitness device of claim 4, wherein the seat and the back are composed of a vinyl covering.

10. The fitness device of claim 4, wherein the frame is composed of metal.

11. A fitness device comprising;

a frame having a horizontal portion with a first side and a second side and a vertical portion with a first side and a second side, the horizontal portion and vertical portion are hingedly connected;

a back engaged to the vertical portion of the frame;

a seat engaged to the horizontal portion of the frame;

two first retention elements engaged to the first side and the second side of the vertical portion of the frame and two second retention elements engaged to the first side and the second side of the horizontal portion of the frame;

biasing elements having a first portion and a second portion, wherein the first portion is engaged to the retention elements on the first side and the second side of the horizontal portion of the frame and the second portion is engaged to the retention elements on the first side and second side of the vertical portion of the frame;

a first arm rotationally engaged to the first side of the vertical portion having a first end and a second end, the second end of the first arm is engaged to a resistance device having a first end and a second end, the first end of the resistance device is engaged to the second end of the first arm and the second end of the resistance device is engaged to an engagement device positioned adjacent a first leg; and a second arm rotationally engaged to the second side of the vertical portion having a first end and a second end, the second end of the second arm is engaged to a resistance device having a first end and a second end, the first end of the resistance device of the second arm is engaged to the second end of the second arm and the second end of the resistance device of the second arm is engaged to an engagement device positioned adjacent a second leg.

12. The fitness device of claim 11, wherein the biasing elements are a retention band.

13. The fitness device of claim 11, further comprising a stabilizer bar disposed between two legs of the fitness device.

14. The fitness device of claim 11, further comprising a first pair of legs and a second pair of legs, wherein the first pair of legs comprises the first leg and the second leg, the first pair of legs and second pair of legs are opposed pairs of legs engaged to the horizontal portion of the frame and containing a stabilizer bar that spans between the first pair of legs and the second pair of legs.

* * * * *